United States Patent [19]

Grabowiecki

[11] Patent Number: 4,872,610

[45] Date of Patent: Oct. 10, 1989

[54] DISPLAY MAILBOX WITH INTERCHANGEABLE INSERTS

[75] Inventor: Robert J. Grabowiecki, Hamden, Conn.

[73] Assignee: G & H Corporation of Connecticut, Inc., New Haven, Conn.

[21] Appl. No.: 194,498

[22] Filed: May 16, 1988

[51] Int. Cl.[4] ..... B65D 91/00

[52] U.S. Cl. ..... 232/17; 232/38

[58] Field of Search ..... 232/38, 17, 1 C, 19, 232/20, 27

[56] References Cited

U.S. PATENT DOCUMENTS

| | | | |
|---|---|---|---|
| 1,542,217 | 6/1925 | Cole | 232/17 |
| 2,467,475 | 4/1949 | Hallamore | 232/19 X |
| 2,578,693 | 12/1951 | Geiseler | 232/19 |
| 2,607,141 | 8/1952 | Petersen | 232/17 X |
| 2,976,633 | 3/1961 | Squire | 232/17 X |
| 3,825,173 | 7/1974 | Sunday | 232/17 |
| 4,244,512 | 1/1981 | Wise | 232/38 X |

*Primary Examiner*—Robert W. Gibson, Jr.

*Attorney, Agent, or Firm*—Delio & Associates

[57] ABSTRACT

A display mailbox for displaying text or graphics on an exterior surface thereof comprising a mailbox enclosure having a recess positioned on its exterior surface bounded by a perimeter wall and a backing wall. At least two flanges are located on the sides of the recess, each flange having an inwardly facing surface projecting over the recess. An insert of sheet material having the text or graphics printed thereon fits into the recess and behind the inwardly facing surfaces of the flanges whereby it is securely held and can be seen on the exterior surface of te mailbox.

16 Claims, 3 Drawing Sheets

DISPLAY MAILBOX WITH INTERCHANGEABLE INSERTS

BACKGROUND OF THE INVENTION

This invention relates to mailboxes and, in particular, to mailboxes on which designs of text or graphics are displayed on the exterior surface thereof.

By law, mailboxes must be marked in some manner with the name and street number of the owner. This is typically accomplished by the purchaser through the use of adhesive lettering, which is a tedious and error-prone task. Painted or stencilled lettering is also occasionally employed. In addition to such text, many mailboxes are provided with decorative graphic designs. Often designs are provided which appeal to a particular class of purchasers. For example, a boat owner may wish to have the design of a boat, a pilot may look for an airplane graphic, etc.

In the past, such graphic designs have typically been applied by the mailbox manufacturer by silk-screening the design onto the exterior surface of the mailbox or onto a sheet material which is wrapped over the exterior and permanently adhered to the mailbox. Adhesive label designs and painting have also been used.

Unfortunately, the application of the design at the manufacturing stage creates severe problems in storage and transportation, particularly where more than one style of mailbox, i.e., post-mount, wall-mount, etc., is to be kept in stock. For even a modest selection of designs, the number of mailboxes to be retained in inventory quickly becomes excessive. Each style must be stored with each different design imprinted thereon. A related problem is the difficulty of gauging purchaser demand for each design. The retailer is often left with too many of the unpopular designs and too few of the best sellers.

The present invention seeks to solve these problems by providing the graphic and/or text design on a separate insert which can be fitted into and retained by a matching recess on the visible exterior surface of the mailbox. Accordingly, a retailer need only stock a sufficient quantity of each basic mailbox style with the recess, and then can keep a much larger selection of low-cost graphic design inserts in a substantially reduced storage space.

A second advantage of this invention is that it permits the display insert to be changed by the mailbox owner when he becomes tired of the original design, when the ownership of the box changes hands, or at other times. For example, the inserts may be changed seasonally to provide holiday designs, birthday wishes, notices of new births, etc.

A third advantage of this interchangeable insert design is that inserts can be produced with the owner's name and street number in addition to or instead of the graphic design. Such inserts can be produced by the mailbox manufacturer or retailer for those customers who do not wish to apply the text themselves. Even where the purchaser applies the text, the job can be performed much more easily on the flat removeable insert than by working directly on the bulky mailbox. If, as is not uncommon, the purchaser makes a mistake during the application of the letters, a second insert can be used or the back of the first one.

SUMMARY OF THE INVENTION

The present invention provides a display mailbox comprising a mailbox enclosure having at least one exterior surface with a recess positioned thereon bounded by a perimeter wall and a backing wall. At least two flanges are provided located on the sides of the recess with each flange having an inwardly facing surface which projects over the recess. An insert of sheet material of appropriate size to fit into the recess and behind the inwardly facing surfaces of the flanges is provided for carrying the design of text or graphics.

The insert is preferably manufactured of a flexible material with the design on its outer surface, such that the insert can be flexed and inserted behind the inwardly facing surfaces of the flanges thereby holding it securely in the recess.

In the preferred embodiment, the mailbox enclosure is formed of molded plastic with the flanges being molded integrally therewith. The recess is indented into and contained entirely within the wall thickness of the exterior wall thereby avoiding any intrusion into the interior of the mailbox.

DETAILED DESCRIPTION OF THE INVENTION

Figure 1:
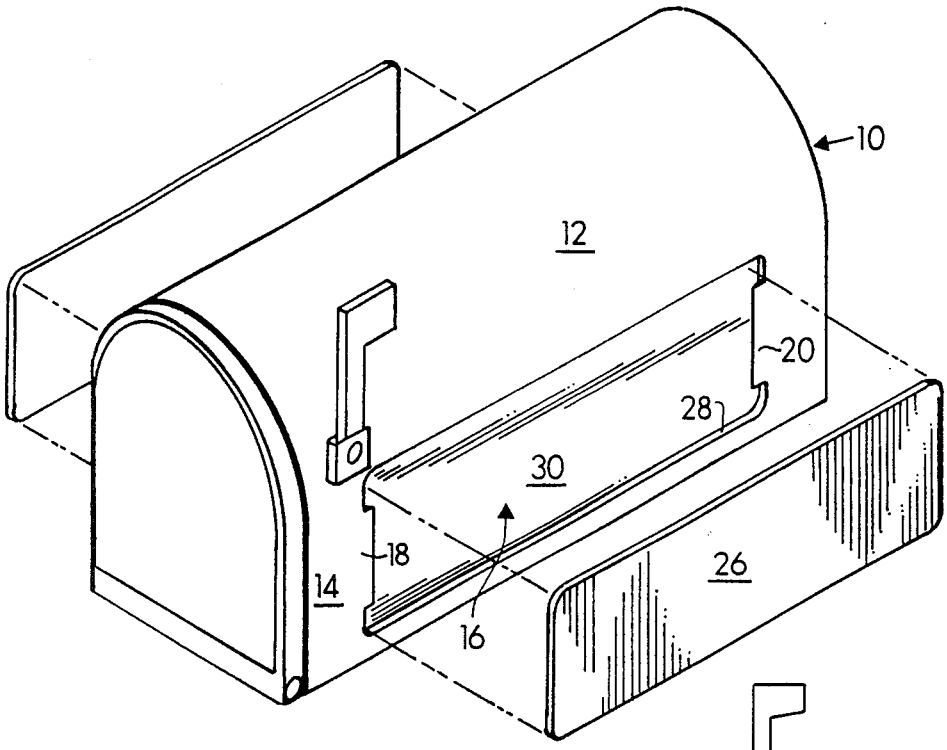
FIG. 1 is a perspective view of the display mailbox of the present invention with two inserts separated from their matching recesses.
Figure 2:
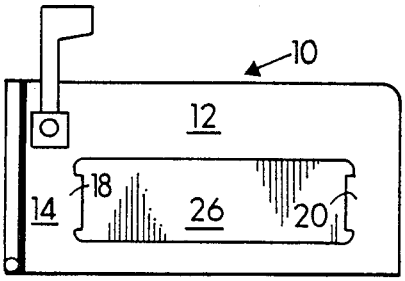
FIG. 2 is a front elevational view of the mailbox of FIG. 1 drawn at a reduced scale.

FIGS. 1 and 2 show a first embodiment of the display mailbox of the present invention. The display mailbox is indicated generally with reference numeral 10 and comprises a mailbox enclosure 12 having at least one exterior surface 14 with a recess 16 positioned thereon.

Figure 3:
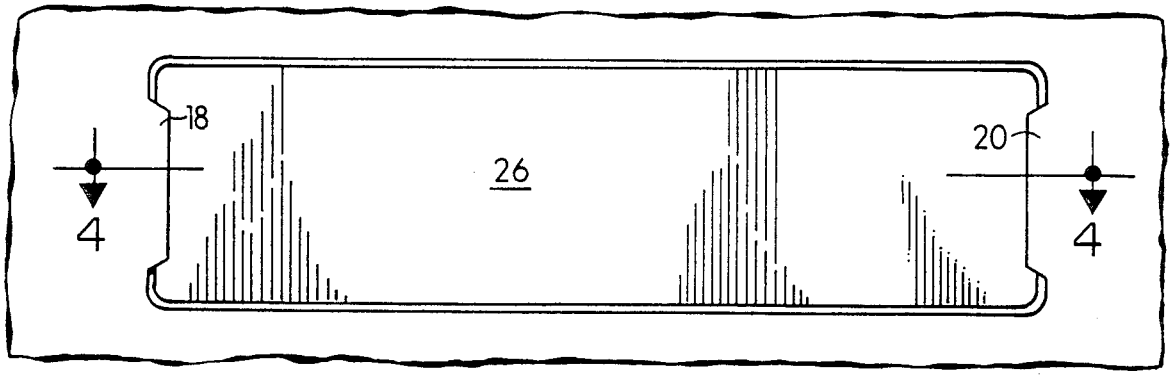
FIG. 3 is a front elevational view of a portion of the exterior wall of the mailbox of FIG. 1 drawn at an increased scale and showing the display insert in detail.

At least two flanges 18, 20 are provided located on the sides of the recess. The details of flanges 18, 20 are seen most clearly in FIGS. 3 and 4. Each flange is provided with an inwardly facing surface 22, 24 behind which all insert 26 can be positioned. The flanges preferably form a matching pair on opposed sides of the recess 16.

The recess 16 preferably comprises a shallow generally rectangular depression in the exterior wall 14. The recess is bounded by a perimeter wall 28 normal to the exterior wall 14 and a backing wall 30 which is substantially parallel to the exterior wall 14.

Figure 4:
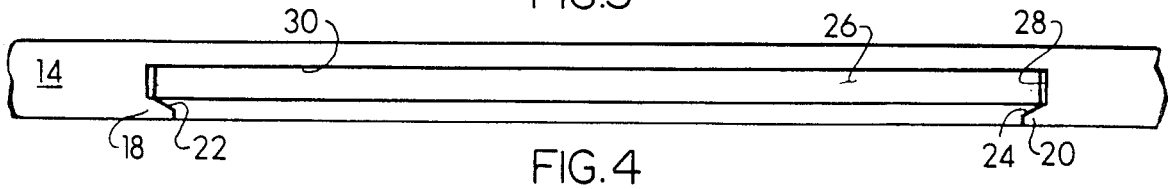
FIG. 4 is a cross sectional view along the line 4—4 of FIG. 3.

As is seen most clearly in FIG. 4, the inwardly facing surfaces 22, 24 of the flanges 18, 20 are advantageously positioned at a slight angle to the plane of the backing wall such that the distance between the inwardly facing surface 22, 24 and the backing wall 30 narrows as the perimeter wall 28 is approached.

The increased distance between the lip of the flanges and the backing wall 30 permits the insert 26 to be easily inserted behind the inwardly facing surfaces 22, 24 when it is flexed or bowed outwardly. Once the flex is released, the narrowing depth of the recess behind the flanges pushes the insert against the backing wall 30 and securely holds it in position in the recess 16.

The mailbox enclosure can be constructed of any material which is commonly used for the construction of mailboxes, including sheet metals, wood or plastic. However, the preferred mailbox manufacturing method is to produce the mailbox of molded plastic. This permits the recess 16 to be introduced into the exterior wall surface 14 at the time the enclosure is molded.

Alternatively, the exterior wall and recess can be constructed of separate components. For example, the exterior wall and recess can be formed of two components, one comprising a substantially planar wall portion corresponding to the backing wall and the other corresponding to the flanges and perimeter wall. The two components may be permanently bonded together by adhesives or ultrasonic or heat welding to form the exterior wall and recess.

The walls of the mailbox enclosure may vary in thickness from as little as 20 thousandths of an inch (0.5 mm) to 200 thousandths of an inch (5.0 mm) or more. However, it is preferably in the range of 60 thousandths of an inch (1.5 mm) to 120 thousandths of an inch (3.0 mm), with 80 thousandths of an inch (2.0 mm) being most highly preferred. This wall thickness provides both a structurally sound mailbox enclosure and sufficient wall thickness for the recess to be formed therein without protruding into the interior of the mailbox enclosure 12. This avoids any interference with mail sliding into the enclosure.

The insert 26 can be of any desired thickness which leaves a sufficient remaining thickness for the exterior wall surface 14 of the enclosure 12. However, the preferred thickness is close to one-half the nominal thickness of the exterior wall 14, i.e., 40 thousandths of an inch (1.0 mm) for the preferred construction.

In the preferred embodiment, the insert 26 is constructed of a flexible sheet plastic material. This permits the insert to be flexed upon insertion to easily slip behind the flanges 18, 20. Nonetheless, other sheet materials such as metal, fiberglass and composites may be advantageously employed.

FIGS. 1 and 2 show a conventional style for the mailbox enclosure 12 which is suitable for post mounting where both sides of the enclosure are visible. Accordingly, it is provided with identical recesses and matching inserts on each side thereof, only one of which is described and discussed in detail. As those skilled in the art will recognize, any mailbox design may be employed as the enclosure provided that at least one exterior surface is available upon which the recess and insert can be positioned.

The three groups of FIGS. 5–7, 8–9 and 10–12 show three alternative embodiments of the invention. The same numerals have been employed in the remaining figures to identify elements which correspond to the elements previously described in connection with FIGS. 1–4.

Figure 5:
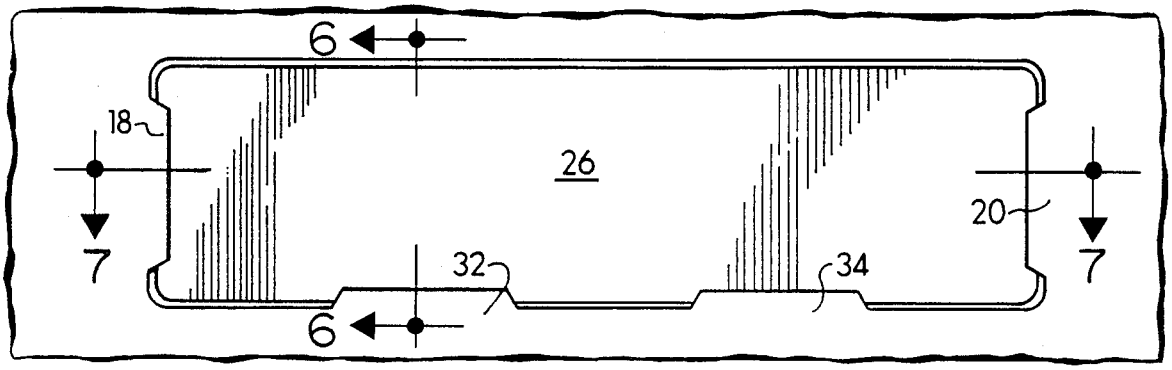
FIG. 5 is a front elevational view of a portion of the exterior wall of the mailbox enclosure showing an alternative embodiment for the insert and recess.
Figure 7:
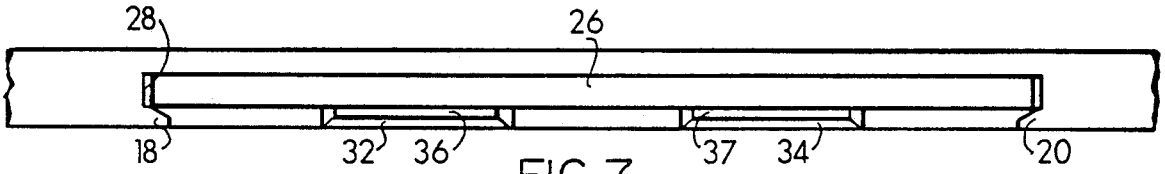
FIG. 7 is a cross sectional view along the line 7—7 of FIG. 5.
Figure 6:
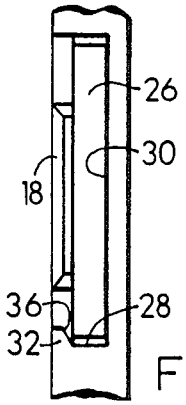
FIG. 6 is a cross sectional view along the line 6—6 of FIG. 5.

FIGS. 5–7 show an embodiment which is substantially identical to that seen in FIGS. 1–4 with the exception of the additional flanges 32, 34. The two additional flanges also have inwardly facing surfaces 36, 37 which, as can be seen in FIGS. 6 and 7, are provided at a slight angle to the backing wall 30.

The additional flanges 32, 34 provide further support for the insert 26 and assist in retaining it securely within the recess. In this configuration, the insert is slipped into the recess from the top rather than being inserted entirely by flexing as described in connection with the embodiment seen in FIGS. 1–4.

Although this embodiment may optionally be employed where the insert is substantially rigid, and therefore must "slide" (with minimal flexing) into the recess from the top, it is preferably employed where the insert is extremely flexible. The additional support from flanges 32, 34 prevents the central region of the insert from accidentally flexing outward which might permit the insert to escape from the recess.

Figure 8:
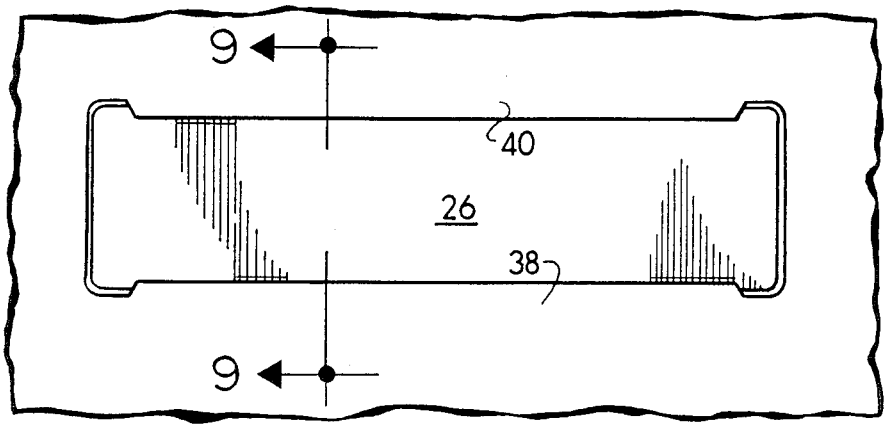
FIG. 8 is another alternative embodiment of the invention showing a different construction for the flanges and recess.
Figure 9:
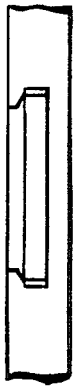
FIG. 9 is a cross sectional view along the line 9—9 of FIG. 8.

The embodiment seen in FIGS. 8 and 9 eliminates the left and right flanges 18, 20 and substitutes therefor flanges 38, 40 at the top and bottom which provide substantially greater support and retention for the insert at the cost of somewhat greater difficulty in inserting and removing the insert. For highly flexible materials, the insert may be flexed along its longest axis during insertion. However, for more rigid materials the insert is preferably slipped into the recess from the left or right side.

Figure 10:
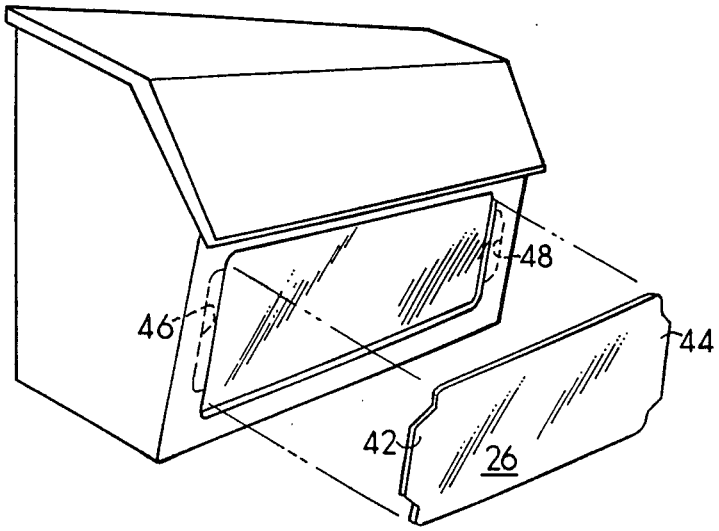
FIG. 10 is a perspective view of a different embodiment of the invention incorporating an alternative mailbox enclosure style.
Figure 12:
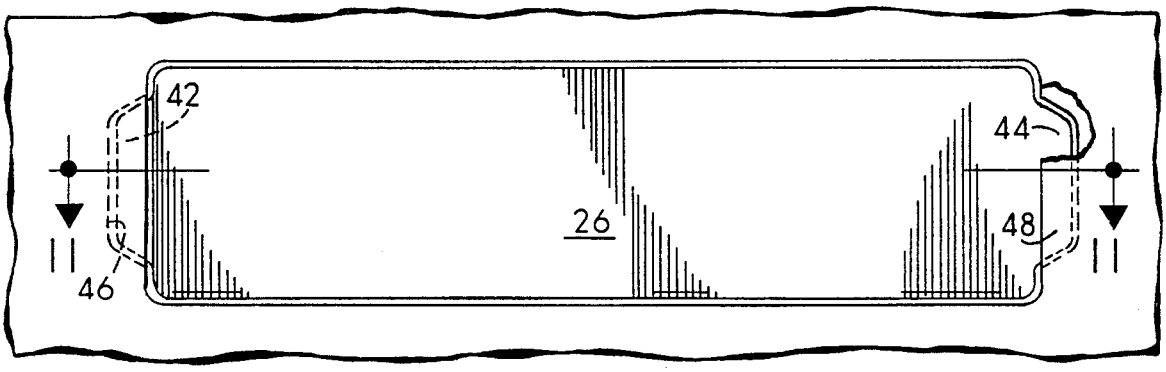
FIGS. 11 and 12 show cross sectional views and partial front elevational views respectively of the embodiment seen in FIG. 10.
Figure 11:
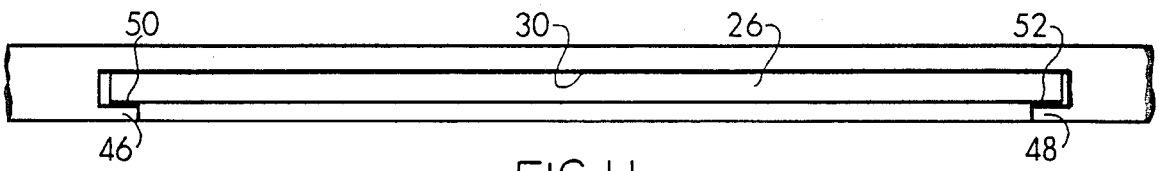

FIGS. 10–12 show another alternative embodiment of the invention. FIG. 10 shows a wall-mount style of mailbox enclosure with the insert and recess positioned on the front. As those skilled in the art will recognize, the choice of the style of mailbox enclosure is entirely optional and any of the recess and insert designs described herein may be employed in combination with any form of mailbox enclosure.

The embodiment of FIGS. 10–12 is slightly preferred over the other designs, principally for asthetic reasons. In this embodiment, the insert 26 is provided with a pair of tabs 42, 44 on opposed sides of the insert. The flanges 46, 48 are integrally molded along the edge of the recess such that with the insert 26 positioned within the recess, the tabs 42, 44 are hidden behind the flanges 46, 48. Thus, the recess in this embodiment has the appearance of a clean unbroken rectangle. The flanges invisibly merge with the surface of the mailbox enclosure forming a rectangular "clear opening" through which the insert graphic is viewed. This may be preferred by some purchasers over the embodiments seen in the previous figures in which the flanges project over the rectangular face of the insert.

Another feature of this design, which can be seen in FIG. 11, is that the inwardly facing surfaces 50, 52 of the flanges 46, 48 are not inclined relative to the backing wall 30 as in the other embodiments. While using inclined facing surfaces makes it easier to insert the design insert, particularly for semi-rigid inserts, the non-inclined facing surfaces have been found to provide a more secure grip and provide better retention of the insert.

While the invention has been shown principally with regard to rectangular inserts, non-rectangular insert shapes such as ovals, hexagons, decorative designs, etc. can also be employed with equal effectiveness.

Although the inserts have been illustrated without the graphic designs thereon, clearly any desired graphic or text can be applied to the outer surface in a conventional manner such as by silkscreening, painting, decalcomania, etc.. Furthermore, alternative designs can be applied to both sides of the insert which permits the design to be quickly changed, merely by reversing the insert.

While this invention has been described with reference to specific embodiments, it will be recognized by those skilled in the art that variations are possible without departing from the spirit and scope of the invention, and that it is intended to cover all changes and modifications of the invention disclosed herein for the purpose of illustration which do not constitute departure from the spirit and scope of the invention.

Having thus described the invention, what is claimed is:

1. A display mailbox comprising:

a mailbox enclosure having at least one exterior surface;

a recess positioned on the exterior surface of the mailbox bounded by a perimeter wall and a backing wall;

at least two flanges located on the sides of the recess, each flange having an inwardly facing surface projecting over the recess; and an insert constructed of sheet material of appropriate size to fit into the recess inside the perimeter wall and behind the inwardly facing surfaces of the flanges whereby it is securely held in the recess, the insert being of suitable size and material for the presentation of a design thereon, and including a pair of opposed tabs which are held under the inwardly facing surfaces of the flanges.

2. A display mailbox according to claim 1 wherein the at least two flanges form a pair located on opposed sides of the recess.

3. A display mailbox according to claim 1 wherein the flanges are intergrally molded into the mailbox enclosure along the sides of the recess thereby hiding the tabs from view.

4. A display mailbox according to claim 3 wherein the recess has a clear opening which is substantially rectangular.

5. A display mailbox comprising:

a molded plastic mailbox enclosure including at least one exterior wall;

an indented recess molded into the exterior wall of the mailbox enclosure;

at least two molded flanges integral with the mailbox enclosure, each flange having an inwardly facing surface which projects over the recess; and an insert of flexible sheet material of approximately the same size as the recess to fit therein and behind the inwardly facing surfaces, thereby holding the insert securely into the recess.

6. A display mailbox according to claim 5 wherein the indented recess is contained entirely within the wall thickness of the exterior wall without protruding into the interior of the mailbox enclosure.

7. A display mailbox according to claim 5 including exactly two molded flanges located on opposed sides of the recess.

8. A display mailbox comprising:

a molded mailbox enclosure having at least one exterior surface;

a recess molded into the exterior surface of the mailbox bounded by a perimeter wall and a backing wall;

at least two flanges located on the sides of the recess said flanges being integral with the exterior surface of the mailbox enclosure, each flange having an inwardly facing surface projecting over the recess; and an insert constructed of sheet material of appropriate size to fit into the recess inside the perimeter wall and behind the inwardly facing surfaces of the flanges whereby it is securely held in the recess, the insert being of suitable size and material for the presentation of a design thereon.

9. A display mailbox according to claim 8 wherein the insert and recess are substantially rectangular.

10. A display mailbox according to claim 8 wherein the at least two flanges form a pair located on opposed sides of the recess.

11. A display mailbox comprising:

a mailbox enclosure having at least one exterior wall surface;

a recess indented into and contained entirely within the wall thickness of the exterior wall surface of the mailbox enclosure without protruding into the interior of the mailbox enclosure, the recess being bounded by a perimeter wall and a backing wall;

at least two flanges located on the sides of the recess, each flange having an inwardly facing surface projecting over the recess; and an insert constructed of sheet material of appropriate size to fit into the recess inside the perimeter wall and behind the inwardly facing surfaces of the flanges whereby it is securely held in the recess, the insert being of suitable size and material for the presentation of a design thereon.

12. A display mailbox according to claim 11 wherein the insert and recess are substantially rectangular.

13. A display mailbox according to claim 11 wherein the at least two flanges form a pair located on opposed sides of the recess.

14. A display mailbox comprising:

a mailbox enclosure having at least one exterior surface;

a recess positioned on the exterior surface of the mailbox bounded by a perimeter wall and a backing wall;

at least two flanges located on the sides of the recess, each flange having an inwardly facing surface projecting over the recess, each inwardly facing surface being inclined at an angle to the backing wall such that the distance between the inwardly facing surface and the backing wall decreases as the perimeter wall is approached; and an insert constructed of sheet material of appropriate size to fit into the recess inside the perimeter wall and behind the inwardly facing surfaces of the flanges whereby it is securely held in the recess, the insert being of suitable size and material for the presentation of a design thereon.

15. A display mailbox according to claim 14 wherein the insert and recess are substantially rectangular.

16. A display mailbox according to claim 14 wherein the at least two flanges form a pair located on opposed sides of the recess.

* * * * *